United States Patent [19]

Coleman

[11] Patent Number: 4,869,190

[45] Date of Patent: Sep. 26, 1989

[54] SOLID STATE POWER FAILURE SQUIB IGNITION CONTROL

[75] Inventor: Jeffrey L. Coleman, San Diego, Calif.

[73] Assignee: The United States of America as represented by the Secretary of the Navy, Washington, D.C.

[21] Appl. No.: 213,033

[22] Filed: Jun. 27, 1988

[51] Int. Cl.[4] ..... F42B 19/42; F42C 11/00

[52] U.S. Cl. ..... 114/20.1; 102/206; 102/218

[58] Field of Search ..... 102/206, 218, 293, 407, 102/411; 114/20.1, 20.2, 22

[56] References Cited

U.S. PATENT DOCUMENTS

| | | | |
|---|---|---|---|
| 1,035,021 | 8/1912 | Laubeuf | 114/331 |
| 2,402,617 | 6/1946 | Fetzer et al. | 114/25 |
| 3,004,507 | 10/1961 | Abrams | 114/20.1 |
| 3,141,434 | 7/1964 | VanBilliard | 114/20.1 |
| 3,153,394 | 10/1964 | Shaver et al. | 114/20.1 |
| 4,200,920 | 4/1980 | Evans et al. | 367/1 |

*Primary Examiner*—Charles T. Jordan

*Attorney, Agent, or Firm*—Harvey Fendelman; Thomas G. Keough

[57] ABSTRACT

A torpedo ejects lead weight at the conclusion of a practice run and is buoyed to the surface for recovery and reuse. A squib is initiated to release the weight by a control circuit which is actuated when the torpedo engine stops. An appropriately interconnected transistor and field effect transistor respond to built-up charges on three charge storage circuits to assure the proper initiation of the squib when the torpedo stops running. The stored energy thus is brought into effect to assure reliable separation and avoids the problems otherwise associated with conventional electromechanical relays.

6 Claims, 1 Drawing Sheet

SOLID STATE POWER FAILURE SQUIB IGNITION CONTROL

STATEMENT OF GOVERNMENT INTEREST

This invention described herein may be manufactured and used by or for the Government of the United States of America for governmental purposes without the payment of any royalties thereon or therefor.

BACKGROUND OF THE INVENTION

Testing of torpedoes and the training of crews usually require launches of test and practice vehicles to determine their effectiveness. After a run is completed, the vehicle, usually a torpedo, is buoyed to the surface and a torpedo recovery boat retrieves it for study and reuse. Because no simple current limiting solution is available, conventional weight release devices have had reliability problems since the electro-mechanical relays tend to be underrated for high current applications. The additional problems of contact corrosion and mechanical failure are inherent in electro-mechanical relays and cannot be completely eliminated without eliminating the relays.

Thus, a continuing need exists in the state of the art for a reliable control circuit for releasing a weight which is not susceptible to false triggering by spurious signals nor has the limitations normally associated with electro-mechanical relays.

SUMMARY OF THE INVENTION

The present invention is directed to providing a control circuit for initiating a squib when a propulsion motor in a torpedo stops. A power source coupled to the propulsion motor provides DC power only while the propulsion motor is on. A first charge storage circuit is coupled to the power source to store an initiating charge. A field effect transistor (FET) is coupled to be normally off and has its drain electrode connected to the first charge storage circuit and its source electrode coupled to the squib. A second charge storage circuit is coupled to the power source to provide a predetermined charge for a bias potential. A bipolar junction transistor (BJT) has its base electrode coupled to the second charge storage circuit and its collector electrode coupled to the gate electrode of the FET. The bias potential keeps the BJT normally off and, consequently, the FET is normally off. A third charge storage circuit is connected to the power source to store an actuating charge and is coupled to the emitter electrode of the BJT. A feed-back loop interconnects the source electrode of the FET and the emitter electrode of the BJT. When the propulsion motor stops, the bias potential of the second charge storage circuit falls, causing the BJT to conduct and, consequently, turn the FET on to conduct the initiating charge to the squib to assure the initiation thereof.

An object of the invention is to provide a reliable control circuit for initiating a squib that releases a lead weight.

Another object is to provide a control circuit using stored energy accumulated while a torpedo is operating to initiate a squib for releasing a weight.

A further object is to provide a control circuit for initiating a squib that rapidly assures the initiation thereof while preventing excessive current that might otherwise induce failure.

Another object is to provide a squib initiating circuit that is actuated when a propulsion motor stops and which resists the effects of spurious signals.

These and other objects of the invention will become more readily apparent from the ensuing specification when taken in conjunction with the drawings and the appended claims.

DESCRIPTION OF THE PREFERRED EMBODIMENT

Figure 1:
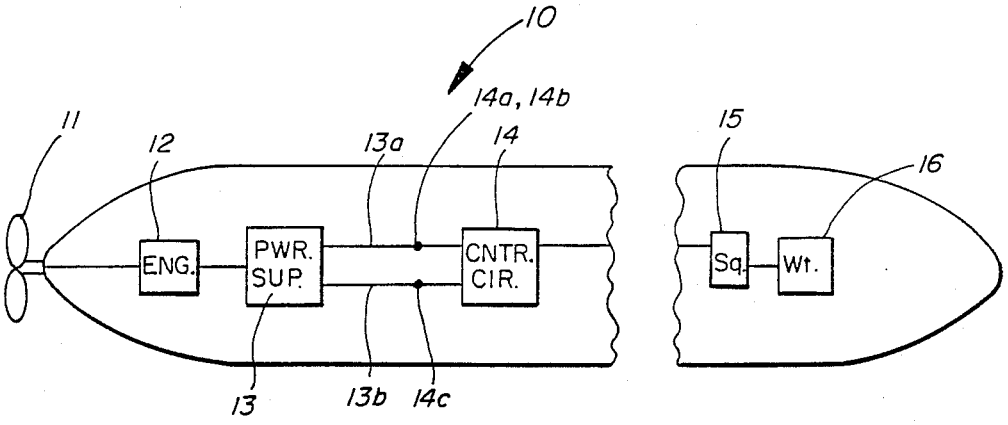
FIG. 1 is a schematic depiction of the invention operationally disposed in a torpedo.

Referring now to FIG. 1, a typical torpedo 10 is at the end of its run with its propellers 11 stopped. This stoppage could be occasioned by any one of several causes such as the expiration of a predetermined duty cycle, the exhaustion of an on-board fuel supply, et cetera, so that a torpedo engine 12 no longer turns the propellers.

When the engine stops, an interconnected on-board alternator in a power supply circuit 13 stops turning so that it no longer provides AC power for a transformer-rectifier network included in the power supply circuit. Prior to the stoppage of the engine, the power supply circuit delivers two levels of DC power at output leads **13*a* and 13*b* for a control circuit module 14**.

The primary purpose of the control circuit is to actuate a squib 15 when power stops coming from circuit 13. When the DC power no longer comes from circuit 13, the squib is initiated (explodes) and weight 16, usually lead, is dropped or ejected from the torpedo. Since the torpedo is positively buoyant without this weight, recovery of the floating torpedo is a simple matter by a torpedo recovery craft.

Figure 2:
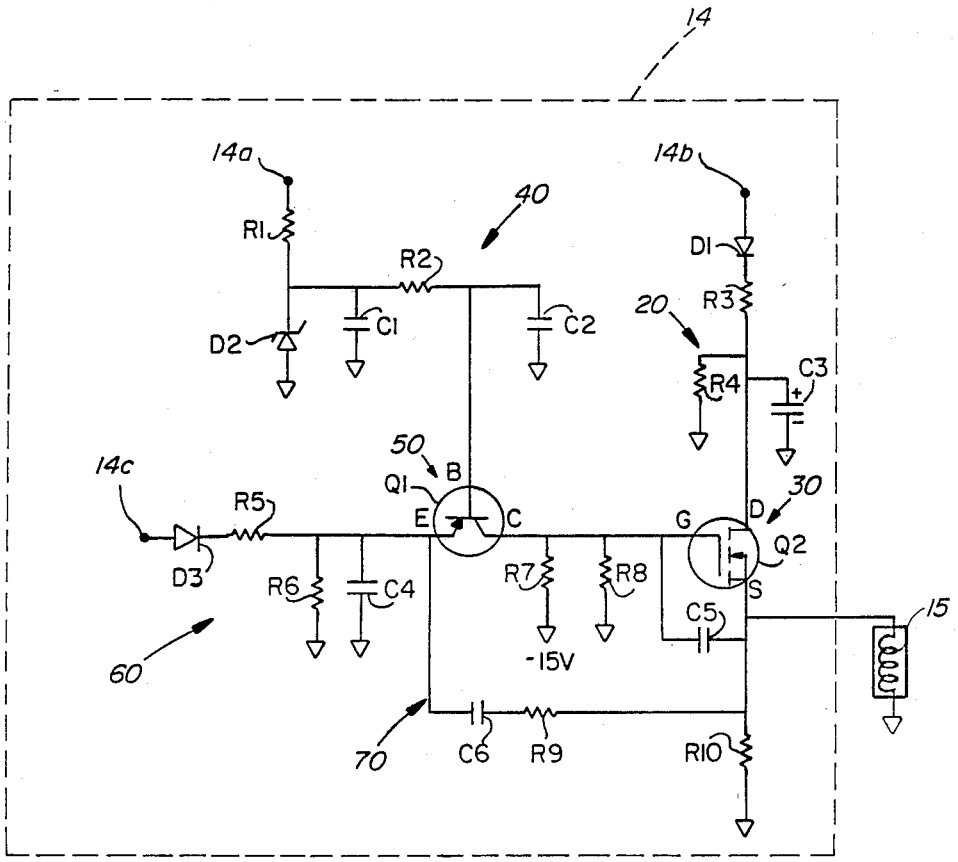
FIG. 2 is a schematic drawing of the principle constituents of the control circuit of this invention.

Looking now to FIG. 2, control circuit 14 receives a first level of DC input power from power source 13 at first input terminals **14*a* and 14*b* and DC power at a second level at an input terminal point 14*c*. These two DC power levels are transmitted to the control circuit via output leads 13*a* and 13*b*, respectively. As mentioned above, the DC power comes from a suitable transformer and rectifier arrangement associated with an alternator that is coupled to torpedo engine 12**. The exact details of the alternator-transformer-rectifiers are not shown since such arrangements are well known in the art and their inclusion is omitted so as not to belabor the obvious.

A first charge storage circuit 20 receives DC power at terminal **14*b* and accumulates an initiating charge on a capacitor C3. A field effect transistor (FET) circuit 30 has a FET Q2 and serves to couple the initiating charge to squib 15 when certain conditions are present, as will be explained below. Upon detonation of the squib, weight 16** is released and the torpedo can rise to the surface.

A second charge storage circuit 40 is appropriately coupled to input terminal **14*a* and provides a predetermined charge on capacitor C2 which acts as a biasing source to inhibit the actuation of a transistor circuit 50. The transistor circuit has a bipolar junction transistor (BJT) Q1, and functions in conjunction with the field effect transistor circuit to inhibit actuation of squib 15** until the torpedo engine stops or runs at a very low speed.

A third charge storage circuit 60 receives the second level of DC power via terminal 14c and stores an accumulating charge on a capacitor C4 that is held there until the torpedo engine stops. A feedback loop 70 interconnects transistor circuit 50 and field effect transistor circuit 30 in such a manner as to further assure the appropriate actuation of squib 15 when the torpedo engine stops.

As torpedo engine 12 provides rotational power for propellers 11, power source 13 provides two levels of DC power, the first level at 40 volts DC at output lead 13a and the lower level at 15 volts DC on lead 13b. A −15 volt level is coupled to a resistor R7, if desired, for the purpose to be explained below. Optionally, the power supplied at input terminal 14c can be delayed approximately 10 seconds to insure that full torpedo power is reached before third charge storage circuit 60 is activated.

+40 volt DC power is applied at terminal 14b and an initiating charge is stored in capacitor C3, via diode D1 and resistor R3 to a +40 volt DC value. Resistor R4 prevents occasional high voltage spikes from integrating and accumulating an excessive charge on capacitor C3. Second charge storage circuit 40 has a resistor R1 and Zener diode D2 to provide a simple +20 volt DC voltage source which is filtered by capacitor C1, resistor R2 and capacitor C2. The charge of circuit 40 is applied to the base electrode of transistor Q1 in circuit 50 to keep the transistor turned off until power fails at the end of a test or a practice run when the torpedo engine stops.

When +15 volts DC is applied at input terminal 14c of the third charge storage circuit 60, capacitor C4 is charged through diode D3 and resistor R5 the capicator is in parallel with resistor R6. Resistor R6 prevents occasional high voltage spikes from integrating and accumulating excessive charge on capacitor C4 as well as providing an automatic discharging path for convenience in testing.

When the torpedo engine quits, the +40 volts DC appearing at input terminals 14a and 14b drops to zero volts DC. This condition causes the voltage at the base electrode of transistor Q1 to fall until transistor Q1 turns on. As transistor Q1 turns on, capacitor C4 discharges through transistor Q1 to the gate electrode of field effect transistor Q2 and capacitor C5. Capacitor C5 charges rapidly and field effect transistor Q2 starts to slowly turn on causing current to flow from its drain electrode to its source electrode which slightly raises the voltage of its source electrode. This small voltage increase is fed back through resistor R9 and capacitor C6 of feedback loop 70 and increases the voltage at the emitter of transistor Q1. This slight voltage increase is amplified by transistor Q1 to increase the rate of rise of the field effect transistor Q2 gate electrode voltage. In this manner, when field effect transistor Q2 starts to turn on, the positive feedback creates a rapid clamping effect which switches field effect transistor Q2 very quickly for low energy dissipation during switching.

With field effect transistor Q2 turned on, capacitor C3 dumps large currents through field effect transistor Q2 to the one ohm squib 15. The limiting factor is the gate electrode voltage which is limited to +15 volts which causes the device to turn off if the source electrode voltage exceeds approximately +10 volts. Squib 15 current thus is limited to approximately 10 amperes.

Empirical data has demonstrated that as squib 15 fires, its resistance drops to virtually zero ohms. When this happens, squib 15 shorts the source electrode of field effect transistor Q2 to ground but capacitor C5 prevents gate-to-source electrode voltage from changing instantaneously. Current is also drawn through resistor R9 and capacitor C6 which reduces the voltage on capacitor C4 and turns off transistor Q1 briefly. As a result, during the instant the squib is firing, current through field effect transistor Q2 is held constant in spite of the reduced squib resistance.

Resistor R8 keeps field effect transistor Q2 gate electrode voltage low when power is off and acts with resistor R7 and a −15 v source to form a voltage divider when power is applied and transistor Q1 is off. This pulls the gate electrode voltage even lower for an increased safety margin.

From the foregoing, it is seen that both positive and negative feedback are selectively employed to create rapid turn on but to limit current during the firing of squib 15. Electro-mechanical relays always have contact bounce which would otherwise limit the turn on speed and create arcing and corrosion. Contact currents exceeding 23 amperes were common in the electro-mechanical relay circuits and always exceeded the specifications of associated elements.

The disclosed control circuit not only limits the current to approximately 10 amperes but uses a switch, a 2N6796, field effect transistor Q2 which is rated at 32 amperes. As a consequence, reliability is improved considerably.

Conceivably a similar circuit could be built using SCR's but such a circuit could be irreversibly triggered by a noise spike. This undesirable event can not occur with the disclosed circuit since it can be turned off after triggering to prevent squib 15 from inadvertently firing.

Typical component value in first charge storage circuit 20 include a 1N4148 diode D1, a 3.9 kilohm resistor R3, a 1 megohm resistor R4 and an 86 microfarad capacitor C3. Field effect transistor circuit 30 can include a 2N6796 field effect transistor Q2 and a 0.01 microfarad capacitor C5. Second charge storage circuit 40 can include a 100 kilohm resistor R1 and 1N5540 20 volt Zener diode D2, a 0.01 microfarad capacitor C1, a 100 kilohm resistor R2 and a 0.1 microfarad capacitor C2.

The transistor circuit 50 might include a 2N2946A transistor Q1, a 1 megohm resistor R7 and a 1 megohm resistor R8. Third charge storage circuit 60 can include a 1N4148 diode D3, a 100 ohm resistor R5, a 10 megohm resistor R6 and a 10 microfarad capacitor C4. Feedback circuit 70 has a one microfarad capacitor C6 and a 100 ohm resistor R9 in association with a 1 kilohm resistor R10.

Any or all of the components enumerated above optionally are replaced by similar components with slightly different values. R1, R2, D2, C1 and C2 may be replaced by any means of 20 VDC generation compatable with the circuit requirements. R4, R6, R10 and R7 could be eliminated with a reduction in safety margin and the output could drive other than the explosive squib if a particular application so requires.

Obviously many modifications and variations of the present invention are possible in the light of the above teachings it is therefore to be understood that within the scope of the appended claims the invention may be practiced otherwise than as specifically described.

What is claimed is:

1. A control circuit for initiating a squib that releases a weight when a propulsion motor in a torpedo stops comprising:

a power source coupled to the propulsion motor to provide DC power only when the propulsion motor is on;

a first charge storage circuit coupled to said power source to store an initiating charge;

a field effect transistor, coupled to be normally off having its drain electrode connected to said first charge storage circuit and its source electrode coupled to said squib;

a second charge storage circuit coupled to the power source to provide a predetermined charge for a bias potential;

a transistor having its base electrode coupled to the said second charge storage circuit and its collection electrode coupled to the gate electrode of said field effect transistor, the bias potential keeps the transistor off and consequently said field effect transistor is normally off;

a third charge storage circuit coupled to said power source to store an actuating charge and being coupled to the emitter electrode of said transistor; and a feedback loop interconnecting the source electrode of said field effect transistor and said emitter electrode of said transistor, when said propulsion motor stops, said DC power stops causing said transistor to conduct and consequently turn said field effect transistor on to feed said initiating charge to said squib to insure the initiation thereof and to release the weight.

2. A control circuit recording to claim 1 further including:

a coupling capacitor connected between the gate electrode and the source electrode of said field effect transistor to prevent excessive current through said field effect transistor in the event that said squib shorts momentarily during initiation.

3. A control circuit according to claim 2 in which the feedback loop includes a serially connected resistor and capacitor to couple an actuation voltage to said emitter electrode of said transistor to assure a rapid turning on of said transistor and said field effect transistor.

4. A control circuit according to claim 3 in which said field effect transistor and said feedback loop are coupled to assure a turn off condition when the source electrode voltage drops a predetermined amount.

5. A control circuit according to claim 4 in which said DC power is provided at a first higher level and a second lower level, said higher level being coupled to said first charge storage circuit and said second charge storage circuit, and said lower level being connected to said third charge storage circuit.

6. A control circuit according to claim 5 further including:

a resistor and negative power source coupled to the collector electrode of said transistor and the gate electrode of said field effect transistor to form a voltage divider when said power source is on to assure that said field effect transistor is normally off.

* * * * *